US005853941A

United States Patent [19]

Rimai et al.

[11] Patent Number: 5,853,941

[45] Date of Patent: Dec. 29, 1998

[54] ELIMINATING TRIBOELECTRICALLY GENERATED BACKGROUND IN AN ELECTROPHOTOGRAPHICALLY PRODUCED IMAGE

[75] Inventors: Donald Saul Rimai, Webster; Salvatore Leone, Rochester, both of N.Y.

[73] Assignee: Eastman Kodak Company, Rochester, N.Y.

[21] Appl. No.: 762,680

[22] Filed: Dec. 11, 1996

[51] Int. Cl.[6] ..... G03G 13/09

[52] U.S. Cl. ..... 430/122; 430/100

[58] Field of Search ..... 430/122, 66, 100; 399/170

[56] References Cited

U.S. PATENT DOCUMENTS

| | | | |
|---|---|---|---|
| 4,546,060 | 10/1985 | Miskins et al. . | |
| 4,602,863 | 7/1986 | Fritz et al. . | |
| 4,712,906 | 12/1987 | Bothner . | |
| 5,376,492 | 12/1994 | Stetler et al. | 430/122 |
| 5,534,978 | 7/1996 | Nakamura et al. | 430/66 |
| 5,640,656 | 6/1997 | Hilbert et al. | 430/122 |
| 5,731,117 | 3/1998 | Ferrar et al. | 430/66 |

OTHER PUBLICATIONS

Schaffert, R.M. Electrophotography. New York: John Wiley & Sons. pp. 30–32, 50, and 51, 1975.

Diamond, Arthur S. (editor) Handbook of Imaging Materials. New York: Marcel–Dekker, Inc. pp. 210–213, 1991.

*Primary Examiner*—Christopher D. Rodee

*Attorney, Agent, or Firm*—Norman Rushefsky

[57] ABSTRACT

A method and apparatus for reducing triboelectrically generated background development on a photoconductive primary image member bearing an electrostatic latent image pattern including background portions. In an electrophotographic black and white or color copier/printer, the primary image member is moved through a development zone. The image member includes a photoconductive element and a thin protective overcoat layer, the overcoat layer being between 0.1 $\mu$m and 15 $\mu$m in thickness and of a composition having between about 0.1% and about 10% by weight of a material that is an ionic conducting material and containing an electronegative group. The latent electrostatic image pattern is formed on the overcoat layer. Electrographic developer includes hard magnetic carrier particles and electrically insulative toner particles and moves through the development zone in contacting developing relation with the electrostatic charge pattern. The developer is transported through the zone in response to rotation of a series of alternating polarity magnets formed in a core which effects tumbling of the carrier in the development zone. The toner particles are tribocharged so that substantially all of the particles are negatively charged and the toner particles have a volume weighted diameter of less than 9 $\mu$m.

32 Claims, 1 Drawing Sheet

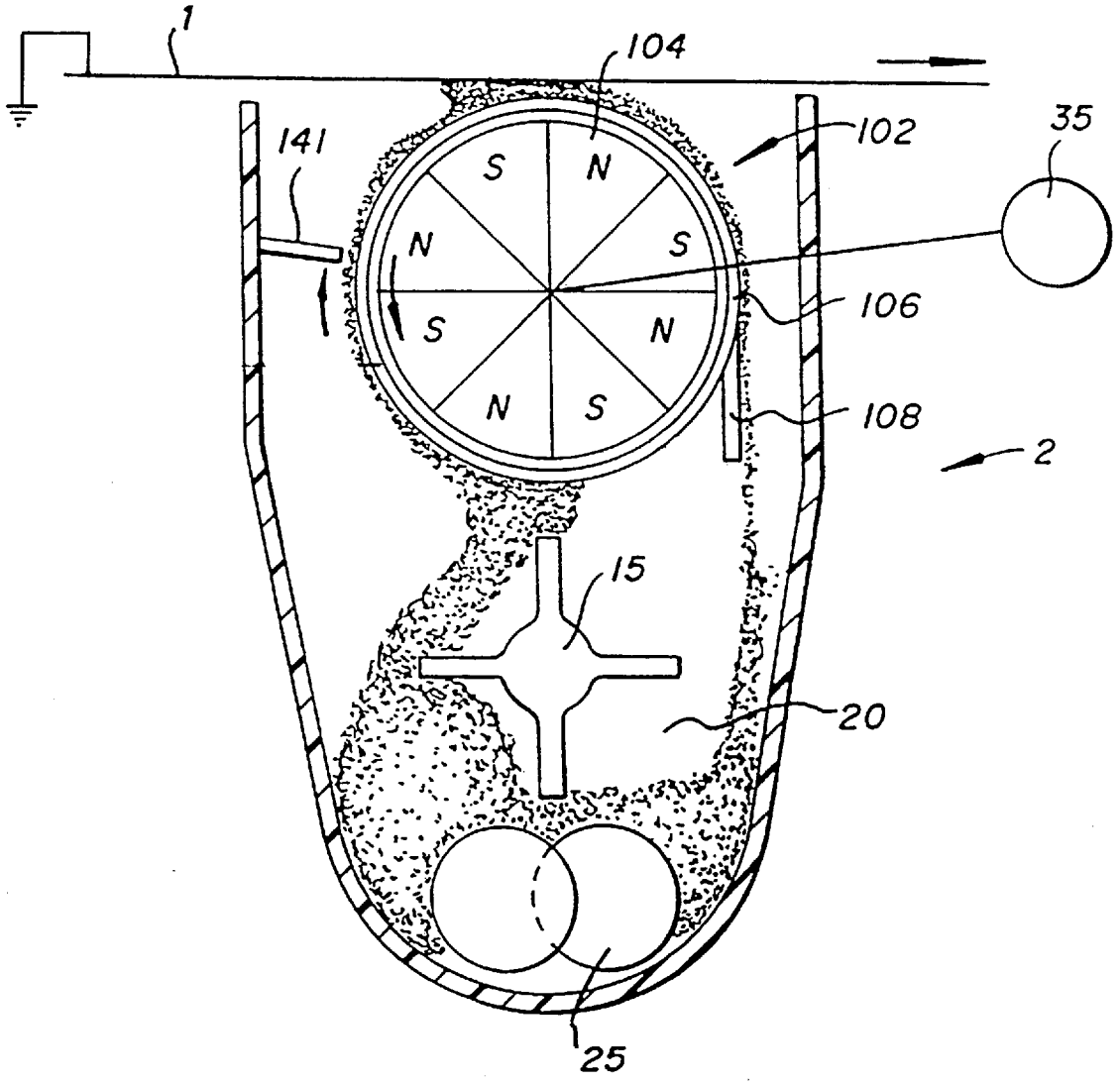
1
104
102
35
141
S
N
N
S
S
N
N
S
106
108
2
15
20
25

ELIMINATING TRIBOELECTRICALLY GENERATED BACKGROUND IN AN ELECTROPHOTOGRAPHICALLY PRODUCED IMAGE

FIELD OF INVENTION

This invention relates to electrophotography. More specifically, it relates to the elimination of triboelectrically generated background development caused by small toner particles having a negative charge, used in a small particle dry (hereafter referred to as SPD) development station when developing an electrostatic latent image on a photoconductor.

BACKGROUND OF THE INVENTION

Dry electrophotographic (i.e., xerographic) images are produced by first uniformly electrically charging a photoconductor with a charger such as a corona charger or roller charger. An electrostatic latent image is then formed by image-wise exposing the photoconductor using a suitable exposure device such as an optical flash, LED array, or laser scanner. The electrostatic latent image is then developed by passing the latent image bearing photoconductor over a suitable development station containing a dry powder developer. There are several different types of known development stations. However, the most commonly used station is a so-called magnetic brush station. Although so-called "single component developers" can be used in the development station, most often the developer is comprised of at least two components: magnetic carrier particles and smaller marking toner particles. The carrier particles are attracted to the magnetic brush in the development station and are used to transport the toner particles to the photoconductor. Moreover, the carrier particles are also comprised of a charge agent which induces a tribocharge on the toner particles. This triboelectrically induced charge on the toner particles causes the particles to become attracted to and develop the electrostatic latent image so that a visible image is produced. The amount of toner actually deposited on the photoconductor is determined by the tribocharge on the toner particles and the difference in the electrical potentials between that on the film and that applied to the development station. Specifically, toner can be deposited onto the photoconductor until the potential difference between the photoconductor and film is zero volts. At this point further deposition of toner particles would result in a potential difference between the development station and the film which would repel any other toner particles, thereby preventing further deposition of toner onto the photoconductor. This is often referred to as complete development. The image-bearing photoconductor is then transported to the transfer subsystem wherein the toned image is transferred to a receiver, such as paper or plastic. Although many forms of transfer can be used, including thermal or pressure, the preferred mode is electrostatic. In electrostatic transfer, an electric field is applied to the receiver using suitable means such as a biased transfer roller or corona. The image-bearing receiver is then transported to a fusing system wherein the image is permanently fixed to the receiver.

In some applications, it is desirable to first transfer the toned image from the photoconductor to an intermediate member. The image is then transferred from the intermediate member to the receiver using means well known in the literature.

In practice, complete development rarely occurs. Rather, the development station tends to also scavenge toner from the photoconductor. In addition the amount of toner transported into the development zone in a given period of time is limited. This results in development efficiencies which are low (typically less than 50%). Although this is seldom a problem for many electrophotographic applications, such as office copiers, because of the relatively low demands placed on the image quality, low development efficiency is a problem for higher quality applications, such as color graphics or photofinishing.

In order to produce higher image quality, the SPD (small particle dry) development station, as described by Fritz et al, in U.S. Pat. No. 4,602,863 (the contents of which are incorporated herein by reference), was developed. By rotating a magnetic core and using carrier particles having volume weighted diameters of about 30 $\mu$m, more uniform development of the electrostatic latent image could be obtained. Furthermore, when combined with small toner particles (i.e. those having volume weighted diameters of less than 9 $\mu$m and preferably 6 $\mu$m or less, as measured using commercially available devices such as a Coulter particle size analyzer), images having very high quality could be produced.

As can be imagined, it is important that, during the process of developing the electrostatic latent image into a visible image, that the toner particles not triboelectrically charge the photoconductor in such a manner so as to increase the attraction between the electrostatically charged toner particles and the photoconductor, as this could result in an undesired background density which is especially noticeable in the low density portions of the image. It is commonly believed that it would be preferred if no triboelectric interaction between the toner and the photoconductor occurred.

Hard overcoats such as sol-gels, which is an example of a glossy solid electrolyte, are known in the literature as coatings for organic photoconductors which protect the photoconductor from physical damage and, thereby, extend the life of the photoconductor. At least one company (Optical Technologies, Inc.) produces sol-gels for use on photoconductors in electrophotographic engines.

The electrical conductivity of hard overcoats such as the aforementioned sol-gel is important if the coating is to function in an electrophotographic engine. Specifically, if the overcoat is too electrically conducting, the electrical charge will tend to diffuse between the formation of the electrostatic latent image and the development of that latent image into a visible image. This would result in blurry images and loss of information. Conversely, if the coating is too electrically resistive, it would prevent the formation of the electrostatic latent image by impeding charge decay during the image-wise exposure process. The conductivity of the coating is frequently determined by the addition of controlled quantities of various ionic conductors. Suitable ionic conductors include materials such as tetrabutyl ammonium iodide and tetramethyl ammonium hydroxide.

Suitable ionic conductors very often have extremely electronegative groups. For example in the aforementioned cases, ammonium iodide and ammonium hydroxide are very electronegative. In the SPD process with positively charging toner particles, the presence of such ionic conductors causes the toner particles, which are electropositive, to charge against the hard overcoated photoconductor. This results in the toner particles becoming electrostatically attracted to and depositing on the photoconductor, thereby resulting in background. The problem has not been reported in other development stations which do not bring forth as much toner into the development region as the SPD process. Moreover, the increase in total surface area of the toner particles when using small toner particles, i.e., less than 9 μm and preferably between about 2 μm and about 6 μm, and the high image quality obtainable from such particles when used in conjunction with the SPD process makes tribocharging and the resultant background especially undesirable and particularly a problem in a color electrophotographic process.

Still another source of background in the SPD process comes from the high agitation rate of the toner, which produces airborne toner particles which randomly deposit on the photoconductor whether toner to photoconductor tribocharging is occurring or not. As small particles tend to stay airborne longer than larger toner particles, rather than recombining with the carrier particles, these also have a greater propensity for depositing on the photoconductor, again causing background.

In summary, undesired toner deposited in a relatively uniform pattern, known as background, is an undesirable image artifact and is especially detrimental in high quality images produced by developing electrostatic latent images on a photoconductor using small toner particles in an SPD development process. The two principal causes of such background are 1) triboelectric charging between the photoconductor and/or photoconductor overcoat layer and the toner particles such that an increased attraction between the toner particles and the photoconductor occurs and 2) random deposition of aerosol borne toner particles onto the photoconductor.

SUMMARY OF THE INVENTION

It is therefore an object of the invention to overcome the problem of undesired background development of an electrostatic latent image formed on an image bearing medium. These and other objects and advantages which will become apparent upon reading of the specification are realized by a method of reducing triboelectrically generated background development on a photoconductive image member bearing an electrostatic latent image pattern including background portions, the method comprising (a) moving said image member through a development zone, the image member including a photoconductive element and a thin protective overcoat layer, the overcoat layer being between about 0.1 μm and about 15 μm in thickness and of a composition having between about 0.1% and about 10% by weight of a material that is an ionic conducting material and containing an electronegative group, the latent electrostatic image pattern being formed on said overcoat layer; and (b) transporting electrographic developer in a development station, the developer including hard magnetic carrier particles and electrically insulative toner particles, through said development zone in contacting developing relation with the electrostatic charge pattern, the developer being transported through said zone in response to rotation of a series of alternating polarity magnets formed in a core which effects tumbling of said carrier in said development zone, the toner particles being tribocharged so that substantially all of the particles are negatively charged and the toner particles having a volume weighted diameter of less than 9 μm.

In accordance with a second aspect of the invention, there is provided an a photoconductive image member bearing an electrostatic latent image pattern including background portions, the image member moving through a development zone, the image member including a photoconductive element and a thin protective overcoat layer, the overcoat layer being between about 0.1 μm and about 15 μm in thickness and of a composition having between about 0.1% and about 10% by weight of a material that is an ionic conducting material and containing an electronegative group, the latent electrostatic image pattern being formed on said overcoat layer; and (b) a development station including electrographic developer, the developer including hard magnetic carrier particles and electrically insulative toner particles in contacting developing relation with the electrostatic charge pattern in the development zone, a rotating magnetic core including a series of alternating polarity magnets which effects tumbling of said carrier in said development zone, the toner particles being tribocharged so that substantially all of the particles are negatively charged and the toner particles having a volume weighted diameter of less than 9 μm.

BRIEF DESCRIPTION OF THE DRAWING

In the detailed description of the preferred embodiments of the invention presented below, reference is made to the accompanying drawing, which is a schematic section of a toning station.

DESCRIPTION OF THE PREFERRED EMBODIMENTS

This invention deals with developing an electrostatic latent image with a two-component developer. Consistent with the terminology in the art, the term "developer" includes at least both "carrier" and "toner" which make up the two component system. In addition, various addenda as are known in the literature can also be included. The carrier includes a magnetizable material and is intended to stay in the development station, preferably until worn out. The toner is charged opposite to the carrier and makes up the toner image. It is constantly replenished in the development station.

The inventors have found that image background produced using negatively charged small toner particles in an SPD development process when developing an electrostatic latent image produced on a photoconductor, particularly an organic photoconductor, could be eliminated by coating the photoconductor with a thin layer (0.1 μm to 15 μm) of a material or composition comprising between about 0.1% and about 10% by weight of a material that is an ionic conducting material containing an electronegative group, such that the toner particles tribocharge against the coating layer in a manner which increased the voltage difference between the photoconductor and the development station. In particular, when negatively charged toner particles are used, it is advantageous to use a coating on the photoconductor comprising a sufficient amount of an electronegative material to allow the toner to tribocharge the uncharged portion of the photoconductor to a voltage between −5 volts and −100 volts when run against an SPD development station containing a developer comprised of carrier particles and toner particles when the film speed is between about 1 inch/second and about 5 inches/second with a magnetic core speed of between about 200 and about 1500 rpm. It is recognized that in the actual development process, development conditions and resulting voltages might be different. However, the conditions set forth prescribe a method of determining whether background due to the triboelectrification will be eliminated in the actual process. The core rotates in a direction counter to that of movement of the photoconductor. This causes the developer to flow in the same direction as the film moves. To match the developer flow speed with the photoconductor velocity, final developer speed is controlled by adjusting the speed of the shell of the development station. Lower voltages would not adequately repel toner, especially under more normal operating conditions (rather than the test conditions) in which the tribovoltages could be smaller. Higher voltages could cause a loss in image density and also result in an increase in the amount of carrier particles deposited on the photoconductor. Although development can be done under other process conditions and the development station need not meet the stated design and conditions in actual imaging operation, the stated conditions are used for evaluation.

According to the drawing, an electrostatic latent image of negative charge has been formed on an image member 1. Image member 1 moves through a developing zone in developing relation with a toning station 2. The toning station includes a sump 20 having a pair of augers 25 which continually mix SPD developer and a paddle 15 which contributes to the mixing and also helps supply the developer to an applicator 102. The applicator 102 includes a rotatable magnetic core 104 having between 8 and 24 magnets that form alternating magnetic poles around its periphery. The strength of the field is at least 450 gauss at the core surface as measured by a Hall effect probe and preferably about 800 to about 1600 gauss. The core is rotatable by a motor 35 so that the portion of the core closest to the image member is moving counter to the image member. Around the core is a shell or sleeve 106 which can be stationary or rotatable and preferably is rotated in a direction to move developer in a direction of and at a speed approximately the movement of the image member 1. This sleeve is preferably non-magnetic and may be made up of aluminum, stainless steel, conductively coated plastic or fiberglass or carbon-filled plexiglass or other suitable material. The toning station also includes an input skive 141 and an output or separation skive 108.

In operation, the sump 20 is loaded with SPD developer. That is, it includes charged toner particles and oppositely charged hard magnetic carrier particles, which hard magnetic carrier particles have a coercivity of at least 300 gauss when magnetically saturated and which exhibit an induced magnetic moment of at least 20 emu/gm of carrier when in an applied field of about at least 1000 gauss. Preferably, the carrier has a much higher coercivity than 300 gauss. A carrier having a coercivity of 2000 gauss and an induced magnetic moment of 55 emu/gm is used commercially. The carrier particles of an SPD developer are distinguished from other two component developers by these "hard" magnetic carrier particles. These hard magnetic carrier particles do not adapt magnetically to a changing field. Rather, they are flipped or tumbled by the changing field. A test for the measurement of coercivity is described in Miskinis et al, U.S. Pat. No. 4,546,060.

Operation of mixing augers 25 and paddle 15 thoroughly mix and charge the developer and make it available to applicator 102. Rapid rotation of core 104 in a counterclockwise direction, as seen in the drawing, creates rapid pole transitions on the surface of sleeve or shell 106. For example, rotation of core 104 between about 200 rpm and about 1500 rpm can cause numerous pole transitions on sleeve 106, the number depending on the number of poles of the core. These rapid pole transitions are resisted by the carrier because of its high coercivity and permanent magnetism. This resistance causes the carrier to flip, which, in turn, causes it to move in a clockwise direction around sleeve 106 and through a development zone in which it contacts image member 1. The movement of the carrier is extremely vigorous. The carrier itself may form strings which have a tendency to flip forward, lying down during the pole transition and sitting up when the center of the pole is opposite it. The developer, thus, appears to move in a wave formation around sleeve 106 with the crests of the wave opposite the centers of the poles. This vigorousness of the developer causes the carrier and toner to move from the surface of the developer to the sleeve and back again continually, thereby recharging the toner and presenting fresh toner to an electrostatic image carried on image member 1.

For best development, the electrostatic image is moved in the same direction and at about the same speed that the developer is moving; i.e., the speed of the developer is within ±15% of the image member's linear speed in the development zone, although within ±7% is preferred and most preferred is equal speeds, with the presentation of fresh toner being maintained by the vigorousness of the rotational or flipping movement of the carrier in response to the rapid pole transitions. The sleeve 106 is spaced from the image member 1 by a distance less than the height of the crests of the developer. The sleeve to image member spacing is typically between about 0.01 inches to about 0.03 inches. This brings the developer into direct contact with image member 1 in the development zone. Because the particles in the developer are constantly moving from the sleeve to the outside of the nap, even in the rollback, fresh toner is being supplied to the image throughout the rollback portion. In order to develop the image, a power supply or voltage source 35 applies a DC voltage to urge development of the electrostatic image.

Suitable toners are comprised of materials known in the art such as polystyrene, polyester, and polyester amide. These toners include a suitable pigment to provide coloration to the image. The pigment may be black or a color, the latter for producing color images. The toner particles are less than 9 $\mu$m in volume weighted diameter and preferably less than about 6 $\mu$m with between about 2 $\mu$m and about 6 $\mu$m being particularly suited for developing color images, wherein plural separation images are combined on a receiver to form a multicolor image such as a full process color image as described in U.S. Pat. No. 4,712,906, the contents of which are incorporated herein by reference. The invention is particularly suited for color copiers or printers in which case plural development stations are provided, each containing a different respective colored toner. As one example, a 4-color copier/printer may be provided with 4 development stations, each with a differently colored respective toner such as cyan, magenta, yellow and black to produce a multicolored image on a receiver sheet. These toners are electroscopic and should be negatively charged against suitable SPD magnetic carriers. The toner particles are triboelectrically charged by the carrier particles and while a few particles may charge positively, the toner particles are substantially all negatively charged; i.e., more than 99% are negatively charged.

Tribocharging of toner and "hard" magnetic carrier is achieved by selecting materials that are so positioned in the triboelectric series to give the desired polarity and magnitude of charge when the toner and carrier particles intermix. If the carrier particles do not charge as desired with the toner employed, the carrier can be coated with a material which does. Such carrier coating can be applied to either composite or binder-free particles. The charging level in the toner is preferably at least 5 $\mu$coul per gram of toner weight. The polarity of the toner charge is negative.

Various resin materials known in the art can be employed as a coating on the "hard" magnetic carrier particles. The choice of resin will depend upon its triboelectric relationship with the intended toner. The developer is formed by mixing the particles with toner particles in a suitable concentration.

Within SPD developer compositions, high concentrations of toner can be employed. Accordingly, the SPD developer preferably contains from about 70 to about 99 weight percent carrier and about 30 to about 1 weight percent toner based on the total weight of the developer; more preferably, such concentration is from about 75 to about 99 weight percent carrier and from about 25 to about 1 weight percent toner; and more preferably, about 93 to about 95 weight percent carrier to about 7 to about 5 weight percent toner.

The toner component of the invention can be a powdered resin which either is black or a colorant that provides the toner with a color, which implies a visible color other than black. It normally is prepared by compounding a resin with a colorant; i.e., a dye or pigment, and any other desired addenda.

Suitable photoconductors are polymeric in nature and are comprised of binders such as polyester, polystyrene, polycarbonate, etc. Suitable overcoat materials include ceramics, sol-gels, ceramers, etc., as are known in the literature. Suitable tribocharging materials within the overcoat include those materials with strong electronegative groups such as various fluorides, nitrates, ammoniums, hydroxides, etc. Especially suitable are materials such as tetrabutyl ammonium iodide and tetramethyl ammonium hydroxide. Suitable concentrations of these materials by weight of the dry, cured coating are between 0.1 and 10.0%. Lower concentrations may not contain sufficient material to adequately tribocharge the photoconductor. Higher concentrations may make the coating too electrically conductive, thereby causing a blurring of the electrostatic latent image. Concentration of these materials can be measured using standard analytical techniques, as are well known in the art, using the dried or cured coatings. The photoconductor member may be in the form of belt or a drum and is an endless photoconductive primary image-forming member.

The photoconductor member 1 can be of various types, including both those commonly referred to as single layer or single-active layer elements and those commonly referred to as multiactive, or multiple-active-layer elements. The photoconductor member 1 has multiple layers, since the member 1 has at least an electrically conductive layer and one photogenerating (charge generating) layer, that is, a layer which includes a charge generation material, in addition to a solid electrolyte overcoat layer.

Single active layer elements are so named because they contain only one layer, referred to as the photoconductive layer, that is active both to generate and to transport charges in response to exposure to actinic radiation. Such elements have an additional electrically conductive layer in electrical contact with the photoconductive layer. In a single active layer member, the photoconductive layer contains charge-generation material to generate electron/hole pairs in response to electromagnetic radiation and a charge-transport material, which is capable of accepting electrons or holes generated by the charge-generation material and transporting them through the layer to effect discharge of the initially uniform electrostatic potential. The charge-transport agent and charge generation material are dispersed as uniformly as possible in the photoconductive layer. The photoconductive layer also contains an electrically insulative polymeric film-forming binder. The photoconductive layer is electrically insulative except when exposed to actinic radiation.

A multiple-active layer photoconductor member is so named because it contains at least two active layers, at least one of which is capable of generating charge, that is, electron/hole pairs in response to exposure to electromagnetic radiation such as light and is therefore referred to as a charge-generation layer (CGL) and at least one of which is capable of accepting and transporting charges generated by the charge-generation layer and is therefore referred to as a charge-transport layer (CTL). A multiple active layer photoconductive member has an electrically conductive layer, a CGL, a CTL and an overcoat layer. Either the CGL or the CTL is in electric contact with both the electrically conductive layer and the remaining CTL or CGL. The CGL contains charge-generation material and a polymeric binder. The CTL contains a charge-transport agent and a polymeric binder.

The polymeric binder used in the preparation of the coating compositions can be any of the many different binders that are useful in the preparation of electrophotographic layers. The polymeric binder is a film-forming organic polymer having a fairly high dielectric strength. In a preferred embodiment of the invention, the polymeric binder also has good electrically insulating properties The binder should provide little or no interference with the generation and transport of the charges in the layer. The binder can also be selected to provide additional functions. Representative binders are film-forming polymers having a fairly high dielectric strength and good electrically insulating properties. Examples of binders are provided in the patent literature and in commonly assigned U.S. application Ser. No. 60/007,252 and now U.S. Pat. No. 5,731,117. Because of the presence of an organic binder and organic photoconductive elements, the photoconductors are referred to as organic photoconductors and are the preferred photoconductors of this invention since they are relatively more subject to wear than inorganic photoconductors. However, the invention is also applicable to inorganic photoconductors.

Any charge generation and transport materials can be utilized in elements of the invention. Such materials include inorganic and organic (including monomeric organic, metallo-organic and polymeric organic) materials; for example, zinc oxide, lead oxide, selenium, phthalocyanine, perylene, arylamine, polyarylalkane, and polycarbazole materials, among others.

CGL's and CTL's in elements of the invention can optionally contain other addenda such as leveling agents, surfactants, plasticizers, sensitizers, contrast control agents, and release agents, as is well known in the art.

The photoconductive member can include various additional layers known to be useful in electrophotographic elements in general, for example subbing layers, barrier layers, and screening layers.

The invention is applicable to photoconductors with various types of overcoat layers such as solid electrolytes including known sol-gels and those described in commonly assigned U.S. application Ser. No. 60/007,252 wherein there is defined a solid electrolyte that comprises a complex of silsesquioxane and a charge carrier, the complex having a surface resistivity from about $1\times10^{10}$ to about $1\times10^{17}$ ohms/sq. and the complex having a $T^2$-silicon/$T^3$-silicon ratio of less than 1:1, the complex having a ratio of carbon atoms to silicon atoms of equal to or greater than about 1.2:1. Other overcoats include ceramer (an organic ceramic) and doped glasses (i.e., those having ionic conductors). The overcoat layer is characterized by substantial nonconductivity of holes or electrons but includes between about 0.1% and about 10% by weight of an ionic conductive substance or molecules that contain an electronegative group. The overcoat layer is between about 0.1 $\mu$m and about 15 $\mu$m in thickness. The overcoat is further characterized by being triboelectric by negatively charged toner in an SPD development station so that the voltage difference between the photoconductor and development station bias is increased. Thus, for example, in a discharge area development system wherein a photoconductor is provided with a uniform negative primary electrostatic charge level, Vo, of typically about −500 volts (±100 volts) by a primary charger, such as a corona charger, for example, and is exposed by an LED or laser printhead or by optical exposure of a negative image original so that background remains at the primary charge level but areas or pixels to be developed are at say various charge levels between typically about −100 volts and about −300 volts (±100), a voltage bias $V_B$ of say about −300 volts (±100 volts) is provided upon the development station (core and/or shell) to urge negatively charged toner to develop the exposed areas on the photoconductor. Tribocharging of the photoconductor by the toner is to both exposed and nonexposed areas and the additional negative charge to the background (nonexposed and lightly exposed) areas tends to discourage development of the background.

The invention is also applicable to a charged area development system wherein image areas to be developed are relatively higher in charge level. In a charged area development system the primary charger applies a uniform positive primary electrotostatic charge level of say about +500 volts (±100 volts) to the photoconductor. After exposure of the photoconductor by the exposure source and prior to entering the development zone, the latent electrostatic charge pattern on the photoconductor has areas of charge that vary typically between about +100 volts and about +500 volts (±100). A bias on the development station $V_B$ of about +300 volts (±100 volts) is provided to urge negatively charged toner to develop the areas charged above +300 volts. Tribocharging of the photoconductor by the toner tends to reduce the voltage level of the background (highest exposed portions) and thereby reduces the likelihood of the development of the background.

EXAMPLES

Example 1

This experiment was designed to determine the amount of toner background generated on an organic photoconductor when brought into contact with an SPD development station containing negatively charged toner. A developer was prepared consisting of 6.5 $\mu$m toner particles at a 6 weight percent in a ferrite carrier. The surface of the toner particles was coated with submicrometer-size silica particles. The toner was also comprised of a charge agent that would cause the toner to charge negatively against the ferrite carrier. The toner charge-to-mass ratio was −38.2 $\mu$C/g. The photoconductor was a commercially available material, which is used in the KODAK Ektaprint 1575/1580 line of copier-printers. This photoconductor was comprised of a KODAK Estar polyethylene terephthalate support layer over which was coated a thin electrically conducting layer. A charge transport layer was coated on top of the electrically conducting layer. Finally, a photoconductive charge generating layer was coated on top of the charge transport layer. It is on top of this layer than toner would be deposited. The photoconductor was passed under a grid controlled corona charger whose charger wires were biased positively and whose grid was grounded and flash exposed to visible light. This would, in effect, ensure that no negative charges were on the photoconductor initially and also fix the voltage on the photoconductor to approximately 0 volts. The photoconductor was then passed over an SPD development station comprised of 20 magnetic bars, alternating in pole orientation, attached to a rotating core. The core was rotated at 400 rpm. Around the core was a stainless steel shell. This shell was not fixed to the core and could be freely rotated in a manner common to SPD stations. This station contained no developer sump and held 12 grams of developer on the aforementioned shell. The photoconductor to shell spacing was approximately 20 mils. The photoconductor was passed over the development station at 2 inches/s. Charging and development was done in total darkness. The development station was electrically grounded. Under these conditions there should be no deposition of toner on the photoconductor. It was found, however, that a distinct blotchy deposition of toner occurred. The transmission density of the deposited toner, as measured using a commercially available densitometer, was 0.04. This is a distinct and undesirable background.

Example 2

The purpose of this experiment was to see if the background observed in example #1 was due to a triboelectric interaction between the toner and the photoconductor. Experimental conditions were similar to those reported in example #1. However, in this case, upon exiting the development zone, the photoconductor was subjected to a blast of compressed air to remove any toner present. The voltage on the photoconductor was measured both before toning and after the air cleaning steps. It was found that, although the potential on the photoconductor was approximately 0 volts prior to the toning step, it was +22 volts after air cleaning. This voltage is due to a triboelectric interaction between the toner and the photoconductor and, being positive, would serve to attract the negatively charged toner. The amount of toner observed in example #1 is consistent with the magnitude of this voltage.

Example 3

An organic photoconductor identical to the one used in examples #1 and #2 was coated with a solution of a commercially available sol-gel, produced by Optical Technologies, Inc. as Ultrashield™. The sol-gel was allowed to dry and was fully cured using known techniques. Analysis showed that the cured sol-gel contained 3–4% by weight tetrabutyl ammonium iodide. This material has been shown to cause triboelectrically generated background in the SPD process when the more common positively charged toner was used. In all other aspects, the conditions used in example #1 were repeated. No background was observed. Densitometry measurements showed that the measured toner background was 0.00 and was indistinguishable from a control film that had not been exposed to the development station at all.

Example 4

This experiment was a repeat of example #2 except that the photoconductor used in example #3 was used. In this instance the triboelectrically generated voltage was −40 volts. This voltage served to repel the negatively charged toner, giving rise to the absence of any background.

There has thus been provided an improved method and apparatus for developing overcoated photoconductors which reduces the problem of background development.

The invention has been described in detail with particular reference to preferred embodiments thereof and illustrative examples, but it will be understood that variations and modifications can be effected within the spirit and scope of the invention.

We claim:

1. A method of reducing triboelectrically generated background development on a photoconductive image member bearing an electrostatic latent image pattern including background portions, the method comprising:

(a) moving said image member through a development zone, the image member including a photoconductive element and a thin protective overcoat layer, the overcoat layer being between about 0.1 μm and about 15 μm in thickness and having between about 0.1% and about 10% by weight a substance that is an ionic conducting substance containing an electronegative group, and the overcoat including a material selected from the group consisting of a sol-gel, a ceramer and a doped glass wherein the glass is doped with said ionic conducting substance, the latent electrostatic image pattern being formed on said overcoat layer;

(b) transporting electrographic developer in a development station, the developer including hard magnetic carrier particles and electrically insulative toner particles, through said development zone in contacting developing relation with the electrostatic latent image pattern to develop the latent image pattern, the developer being transported through said zone in response to rotation of a series of alternating polarity magnets formed in a core which effects tumbling of said carrier in said development zone, the toner particles being tribocharged so that substantially all of the particles are negatively charged and the toner particles having a volume weighted diameter of less than 9 μm; and wherein the electrostatic latent image pattern is negatively charged and in step (b) the toner particles tribocharge the photoconductive image member to increase negative voltages on the image member by between −5 volts and −100 volts.

2. The method of claim 1 whrein the image member is moving through the development zone at a speed between about 1 inch/second and about 5 inches/second and the core is rotating at a speed of between about 200 and about 1500 rpm.

3. The method of claim 1 wherein the magnetic carrier particles have a coercivity of at least 300 gauss when magnetically saturated and exhibit an induced magnetic moment of at least 20 emu/gm of carrier when in an applied field of 1000 gauss.

4. The method of claim 1 wherein a DC negative voltage of about −300 volts is applied to the development station and background areas of the electrostatic latent image pattern are about −500 volts.

5. The method of claim 1 wherein the image member is an organic photoconductive member.

6. The method of claim 1 wherein the ionic conducting substance is selected from the group consisting of tetrabutyl ammonium iodide and tetramethyl ammonium hydroxide.

7. The method of claim 1 wherein the toner particles have a volume weighted diameter of less than about 6 μm.

8. The method of claim 7, wherein the toner particles have a color other than black.

9. The method of claim 1 wherein the toner particles have a color other black.

10. The method of claim 1 wherein magnetic carrier particles have a volume weighted diameter of about 30 μm.

11. The method of claim 1 wherein the material is a sol-gel.

12. The method of claim 1 wherein the material is a ceramer.

13. A method of reducing triboelectrically generated background development on a photoconductive image member bearing an electrostatic latent image pattern including background portions, the method comprising:

(a) moving said image member through a development zone, the image member including a photoconductive element and a thin protective overcoat layer, the overcoat layer being between about 0.1 μm and about 15 μm in thickness and having between about 0.1% and about 10% by weight a substance that is ionic conducting substance containing an electronegative group, and the overcoat including a material selected from the group consisting of a sol-gel, a ceramer and a doped glass wherein the glass is doped with said ionic conducting substance, the latent electrostatic image pattern being formed on said overcoat layer:

(b) transporting electrographic developer in a development station, the developer including hard magnetic carrier particles and electrically insulative toner particles, through said development zone in contacting developing relation with the electrostatic latent image pattern to develop the latent image pattern, the developer being transported through said zone in response to rotation of a series of alternating polarity magnets formed in a core which effects tumbling of said carrier in said development zone, the toner particles being tribocharged so that substantially all of the particles are negatively charged and the toner particles having a volume weighted diameter of less than 9 μm; and wherein the electrostatic latent image pattern is positively charged and in step (b) the toner particles tribocharge the photoconductive image member to decrease positive voltages on the image member by between 5 volts and 100 volts.

14. The method of claim 13, wherein the development station is biased to about +300 volts and background areas of the electrostatic latent image pattern are about +500 volts.

15. A method of recording images on a photoconductive image member with reduced triboelectrically generated background development, the method comprising:

(a) corona charging said image member with a uniform primary charge;

(b) exposing the image member to form an electrostatic latent image pattern;

(c) moving said image member through a development zone, the image member including a photoconductive element and a thin protective overcoat layer, the overcoat layer being between about 0.1 μm and about 15 μm in thickness and of a composition having between about 0.1% and about 10% by weight a substance that is an ionic conducting substance containing an electronegative group, the latent electrostatic image pattern being formed on said overcoat layer;

(d) transporting electrographic developer in a development station, the developer including hard magnetic carrier particles and electrically insulative toner particles, through said development zone in contacting developing relation with the electrostatic latent image pattern to develop the latent image pattern, the developer being transported through said zone in response to rotation of a series of alternating polarity magnets formed in a core which effects tumbling of said carrier in said development zone, the toner particles being tribocharged so that substantially all of the particles are negatively charged and the toner particles having a volume weighted diameter of less than 9 m; and wherein the electrostatic latent image pattern is negatively charged and in step (d) the toner tribocharges the photoconductive image member to increase negative voltages on the imaged member by between −5 volts and −100 volts.

16. The method of claim 15 wherein the overcoat layer is a solid electrolyte.

17. The method of claim 15 wherein the image member is moving through the development zone at a speed between about 1 inch/second and about 5 inches/second and the core is rotating at a speed of between about 200 and about 1500 rpm.

18. The method of claim 15 wherein the magnetic carrier particles have a coercivity of at least 300 gauss when magnetically saturated and exhibit an induced magnetic moment of at least 20 emu/gm of carrier when in an applied field of 1000 gauss.

19. The method of claim 18, wherein the image member is moving through the development zone at a speed between about 1 inch/second and about 5 inches/second and the core is rotating at a speed of between about 200 and about 1500 rpm.

20. The method of claim 15 wherein a DC negative voltage of about −300 volts is applied to the development station and background areas of the electrostatic latent image pattern are about −500 volts.

21. The method of claim 15 wherein the image member is an organic photoconductive member.

22. The method of claim 15 wherein the ionic conducting substance is selected from the group consisting of tetrabutyl ammonium iodide and tetramethyl ammonium hydroxide.

23. The method of claim 15 wherein the toner particles have a volume weighted diameter of less than about 6 $\mu$m.

24. The method of claim 23 wherein the toner particles have a color other than black.

25. The method of claim 15 wherein the toner particles have a color other black.

26. The method of claim 15 wherein magnetic carrier particles have a volume weighted diameter of about 30 $\mu$m.

27. The method of claim 15 wherein the overcoat layer includes a material selected from the group consisting of a sol-gel, a ceramer and a doped glass wherein the dopant in the dosed glass is the ionic conducting substance.

28. The method of claim 15 wherein the overcoat layer includes a sol-gel.

29. The method of claim 15 wherein the overcoat layer includes a ceramer.

30. The method of claim 15 wherein the toner particles have a volume weighted diameter between about 2 $\mu$m and about 6 $\mu$m.

31. A method of recording images on a photoconductive image member with reduced triboelectrically generated background development, the method comprising;

(a) corona charging said image member with a uniform primary charge;

(b) exposing the image member to form an electrostatic latent image pattern;

(c) moving said image member through a development zone, the overcoat layer, the overcoat layer being between about 0.1 $\mu$m and 15 $\mu$m in thickness and of a composition having between about 0.1% and about 10% by weight a substance that is an ionic conducting substance containing an electronegative group, the latent electrostatic image pattern being formed on said overcoat layer, (d) transporting electrogranhic developer in a development station, the developer including hard magnetic carrier particles and electrically insulative toner particles, through said development zone in contacting developing relation with the electrostatic latent image pattern to develop the latent image pattern, the developer being transported through said zone in response to rotation of a series of alternating polarity magnets formed in a core which effects tumbling of said carrier in said development zone, the toner particles being tribocharged so that substantially all of the particles are negatively charged and the toner particles having a volume weighted diameter of less than 9 $\mu$m; and wherein the electrostatic latent image pattern is positively charged and the toner tribocharges the photoconductive image member to decrease positive voltages on the image member by between 5 volts and 100 volts.

32. The method of claim 1 wherein the toner particles have a volume weighted diameter between about 2 $\mu$m and about 6 $\mu$m.

* * * * *